US007086971B2

(12) United States Patent
Zmetra

(10) Patent No.: US 7,086,971 B2
(45) Date of Patent: Aug. 8, 2006

(54) DEVICE TO RETRIEVE AND POSITION A GOLF ARTICLE

(76) Inventor: William J. Zmetra, 198 Kildeer Island Rd., Webster, MA (US) 01570

( * ) Notice: Subject to any disclaimer, the term of this patent is extended or adjusted under 35 U.S.C. 154(b) by 0 days.

(21) Appl. No.: 10/778,829

(22) Filed: Feb. 13, 2004

(65) Prior Publication Data

US 2005/0181886 A1 Aug. 18, 2005

(51) Int. Cl.
*A63B 47/02* (2006.01)
*A63B 57/00* (2006.01)

(52) U.S. Cl. ..... 473/386; 294/19.2
(58) Field of Classification Search ..... 473/284, 473/286, 131–134, 136, 386; 294/19.2
See application file for complete search history.

(56) References Cited

U.S. PATENT DOCUMENTS 682,681 A 9/1901 Haas
1,380,526 A 6/1921 Carpenter
1,625,911 A 4/1927 Richards
2,523,942 A 9/1950 Ciambriello
2,609,198 A 9/1952 Armstrong
2,760,807 A 8/1956 Watson
3,114,557 A 12/1963 Cabot ..... 273/202
3,408,079 A 10/1968 Kirikos ..... 273/202
3,579,894 A 5/1971 Kidder ..... 43/6
3,658,331 A * 4/1972 Driscoll ..... 473/386
3,889,946 A 6/1975 Setecka ..... 273/33
3,901,545 A 8/1975 Shott ..... 294/19 A
4,017,082 A * 4/1977 Channing et al. ..... 473/285
4,021,068 A 5/1977 Piazza ..... 294/19 A
4,313,604 A 2/1982 Baxter ..... 273/32 A
4,522,438 A 6/1985 Logue ..... 294/19.2
4,819,938 A 4/1989 Hill ..... 273/32.5
D301,046 S 5/1989 Morabeto ..... D21/208
4,951,947 A * 8/1990 Kopfle ..... 473/133
4,969,646 A 11/1990 Tobias ..... 273/32.5
4,998,732 A 3/1991 Gallant ..... 273/212
5,052,689 A 10/1991 Lettrich ..... 273/183 A
5,165,744 A 11/1992 Vogrin ..... 294/19.2
5,171,010 A 12/1992 Lanoue ..... 273/32.5
5,211,395 A 5/1993 Liao ..... 273/32 A
5,242,161 A 9/1993 Wilkirson ..... 273/32.5
5,310,177 A 5/1994 Conrad et al. ..... 273/32.5
5,383,659 A 1/1995 Taylor ..... 273/32 B
5,395,146 A 3/1995 Liu et al. ..... 294/19.2
D360,006 S 7/1995 Samples ..... D21/208
5,437,289 A 8/1995 Liverance et al. ..... 128/779

(Continued)

OTHER PUBLICATIONS

Lylah M. Alphonse, "Help on the tee for aching joints," Boston Sunday Globe, Apr. 27, 2003, M12 Travel.

*Primary Examiner*—Stephen Blau
(74) *Attorney, Agent, or Firm*—Burns & Levinson LLP; Jacob N. Erlich; Peter J. Borghetti

(57) ABSTRACT

A device for retrieving and positioning of golfing articles, such as a golf ball and tee, to eliminate the repeated bending down of the golfer. One embodiment of the device includes a rigid tube with a closed end, a resilient cup-like element, and a biased elongated member. The closed end of the tube can be either integral to the tube, such as being molded during the manufacturing process, or an end cap that is fitted to one end of the tube.

14 Claims, 7 Drawing Sheets

U.S. PATENT DOCUMENTS

| | | | | |
|---|---|---|---|---|
| 5,437,488 | A | 8/1995 | Richmond et al. | 294/19.2 |
| 5,485,999 | A * | 1/1996 | Hull et al. | 473/286 |
| 5,499,813 | A | 3/1996 | Black | 273/32.5 |
| D370,041 | S | 5/1996 | Thomas | D21/208 |
| 5,540,432 | A | 7/1996 | Keller | 473/386 |
| 5,624,333 | A | 4/1997 | Dayton | 473/386 |
| 5,634,862 | A | 6/1997 | Gamache | 473/386 |
| 5,707,303 | A | 1/1998 | Berkowitz et al. | 473/386 |
| 5,720,677 | A | 2/1998 | Rudduck | 473/387 |
| 5,735,758 | A | 4/1998 | Miketinac | 473/386 |
| 5,765,647 | A | 6/1998 | Hood | 172/371 |
| 5,857,927 | A | 1/1999 | Driscoll et al. | 473/386 |
| 5,913,737 | A * | 6/1999 | Park | 473/386 |
| 5,921,598 | A | 7/1999 | Bredow | 294/19.2 |
| D413,640 | S | 9/1999 | Fearer, III | D21/718 |
| 6,004,227 | A | 12/1999 | Petersen | 473/386 |
| 6,186,907 | B1 | 2/2001 | Woodward | 473/400 |
| 6,254,497 | B1 | 7/2001 | Brant et al. | 473/386 |
| 6,273,833 | B1 | 8/2001 | Murphy | 473/386 |
| 6,338,685 | B1 | 1/2002 | Posluszny | 473/386 |
| 6,447,407 | B1 | 9/2002 | Caldwell | 473/408 |
| 6,475,107 | B1 | 11/2002 | Sand | 473/398 |
| 6,485,075 | B1 | 11/2002 | McClain | 294/19.2 |
| 6,716,118 | B1 * | 4/2004 | Asta | 473/406 |

* cited by examiner

DEVICE TO RETRIEVE AND POSITION A GOLF ARTICLE

BACKGROUND OF THE INVENTION

This invention relates to a device for the retrieving and positioning of golfing articles, and in particular to a device that eliminates the repeated bending down of the golfer to retrieve and position golf balls and golf tees.

Many golfers due to their age or other physical disabilities minimize their practice or playtime because of the constant stooping to perform certain tasks, such as retrieving and positioning of golf balls and tees. There also can be added risk of injury (such as back and knees), dizziness or accentuation of existing aches and pains. The elimination of the repeated bending will allow them to increase their practice and playtime without the adverse effect caused by bending over.

Though many devices have been disclosed that place and retrieve a golf ball or tee, they all are complex in design and use and are expensive to manufacture.

It is therefore an object of this invention to provide an inexpensive and simple-to-use golf aid that retrieves and positions a golf ball and/or golf tee without the user bending over.

BRIEF SUMMARY OF THE INVENTION

The object set forth above as well as further and other objects and advantages of the present invention are achieved by the embodiments of the invention described hereinbelow.

The preferred embodiment of the invention includes a rigid tube with a closed end, a resilient cup-like element, and a biased elongated member. The closed end of the tube can be either integral to the tube, such as being molded during the manufacturing process, or an end cap that is fitted to one end of the tube. For illustration purposes, the end cap will be described in detail. The tube is capped at each end: one end by an end cap and the other end by a resilient cup-like element. The end cap and the resilient cup-like element have an opening, such as a hole, through the center of which each end of the biased elongated member can extend through, allowing the biased elongated member to slide within the tube along a line of action when a force is applied at one end of the elongated member. The resilient cup-like element is capable of picking up a loose golf ball from the ground, mat, or practice basket. One example of a means for biasing the elongated member is a helix spring trapped within the tube that abuts a shoulder or obstruction of the tube or resilient cup-like element surface and a shoulder of the elongated member, such that when the one end of the elongated member is depressed toward the tube, the shoulder or obstruction of the elongated member forces the helix spring to compress as the spring contacts the shoulders or obstructions or surfaces of the tube or resilient cup-like element. The helix spring will decompress when the force on the elongated member is released.

An alternative embodiment includes a hemispherical shaped ejector attached to the biased elongated member within the resilient cup-like element for a more even distribution of pressure on to the golf ball. The even pressure distribution on the golf ball will eliminate the point contact on the golf ball that may cause damage to the golf ball, and will improve the control of the golf ball when released.

Another alternative embodiment includes a golf tee retriever and positioner, preferably, attached to the tube adjacent to the resilient cup-like element. However, the golf tee retriever and positioner can be located anywhere on the tube. The golf tee retriever and positioner includes a pair of fork members spaced apart to receive the head of the tee or a special projection attached to the tee to hold the tee for positioning. The upper forked member or projection can be used to apply a force to the top of the tee or the projection to push the tee into the ground. The lower forked member or projection can also be used to apply a force to the tee projection when the lower forked member is positioned above such tee projection. The end portions of the upper and/or lower forked members or projections can include a tapered end to assist in the removal to the imbedded tee from the ground. The tapered end can slide beneath the tee projection, similar to a wedge, to extract the tee from the ground.

The forked members can be removably attached to the tube. Also, the base and/or the forked members can be made of material having characteristics, such as magnetic or adhesive, to pick up objects. For example, a tee imbedded with magnetic fibers will be attracted to the lower forked member made of magnetic materials.

For a better understanding of the present invention, together with other and further objects thereof, reference is made to the accompanying drawings and detailed description and its scope will be pointed out in the appended claims.

DETAILED DESCRIPTION OF THE INVENTION

Figure 1A:
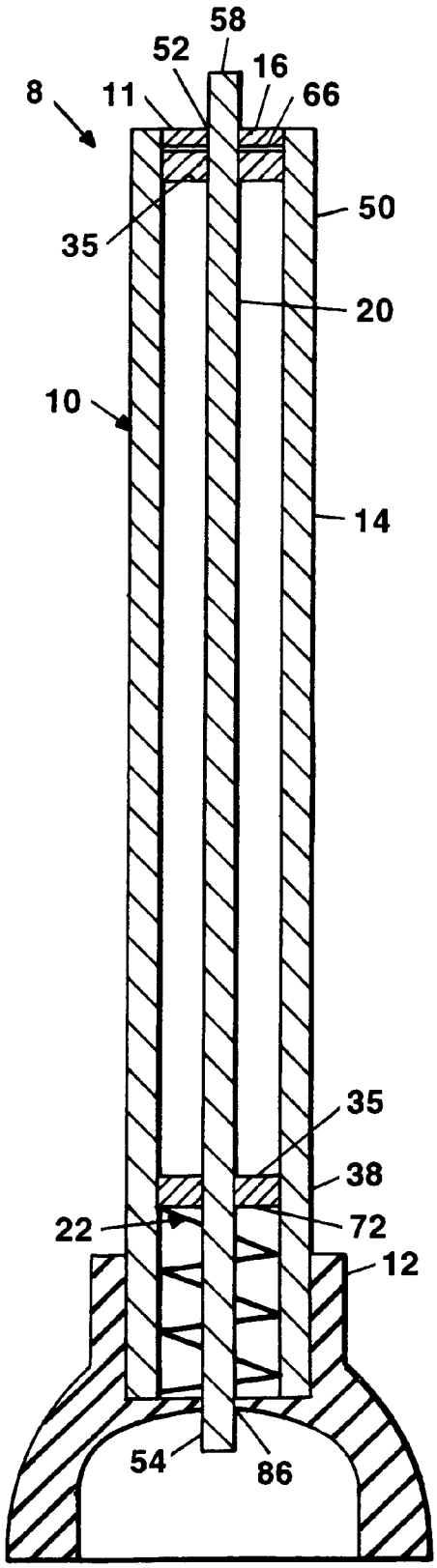
FIGS. 1*a* and 1*b* are sectional views of one embodiment of the present invention illustrating golf ball and golf tee retriever and positioner aides.

In general, the body of one embodiment of the invention or golf aid 8 includes a rigid tube 14, a resilient cup-like element 12 fitted to an end 38 of the tube 14, and a biased elongated member 20 slidably disposed within the rigid tube 14 (FIG. 1*a*). Each end 38, 50 of the golf aid 8 is closed or capped with openings 52, 86 to retain the biased elongated member 20 along a line of action to facilitate the sliding of the biased elongated member 20 within the rigid tube 14. The openings 52, 86 can be disposed in either ends integrated into the tube or removable end caps 16 (described in detail below). However, at least one end of the rigid tube 14 should be open to assemble the biased elongated member 20 into the rigid tube 14 where the opened end 11 is capped 16 after assembly of the biased elongated member 20.

There are various combinations of opened and closed ends that are all acceptable with examples listed below. The closed end of the tube can be either integral to the tube, such as being molded during the manufacturing process, or an end cap or the resilient cup-like element that is fitted to one end of the tube. For illustration purposes, the end cap will be described in detail below. However, any structure or manufacturing process that results in capped ends of the tube is suitable. A permanent end cap can be molded or formed integral to the rigid tube by manufacturing. Removable end caps included the resilient cup-like element attached to the rigid tube by conventional means, such as threaded, interference fit, snap-on connection. Another example of a removable end cap is described herein and will be used as an illustration.

Figure 1B:
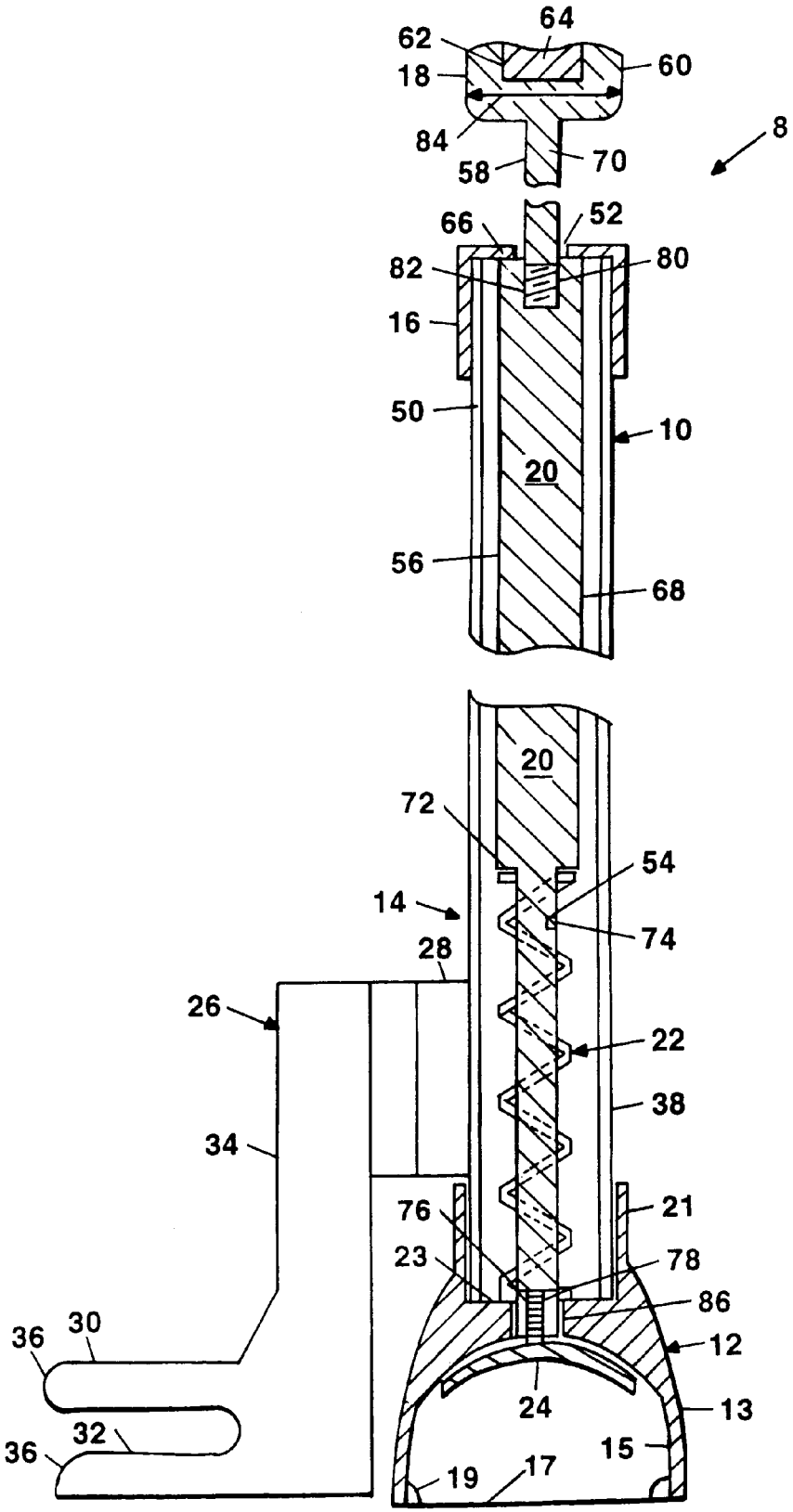

In the drawings, FIGS. 1*a* and 1*b* generally illustrate the golf aid 8 for retrieving and positioning golf balls and tees. The golf aid 8 can include a golf ball retriever and positioner or golf ball device 10 and a golf tee retriever and positioner or golf tee device 26 (FIG. 1*b*). The golf ball device 10 comprises a resilient cup-like element 12; a rigid, hollow, tube 14; an end cap 16; an optional plunger knob 18 (FIG. 1*b*), and an elongated member 20 of longer length than the tube 14; a biasing element 22; and a optional ball ejector 24 (FIG. 1*b*). The golf tee device 26 can include a base member 28; an upper fork projection or member 30; a lower fork projection or member 32; and an attachment block 34. The upper and lower fork members 30, 32 can include a tapered end 36 for easy removal of a golf tee from the ground.

Figure 2C:
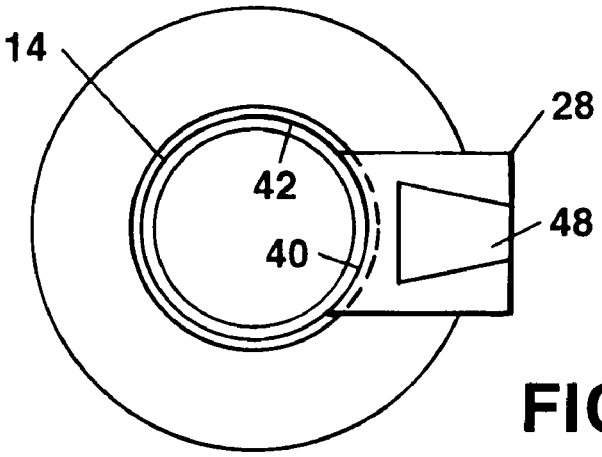
FIGS. 2*b–c* are frontal and top views of the golf tee aid base member illustrated in FIG. 2*a;*
Figure 2A:
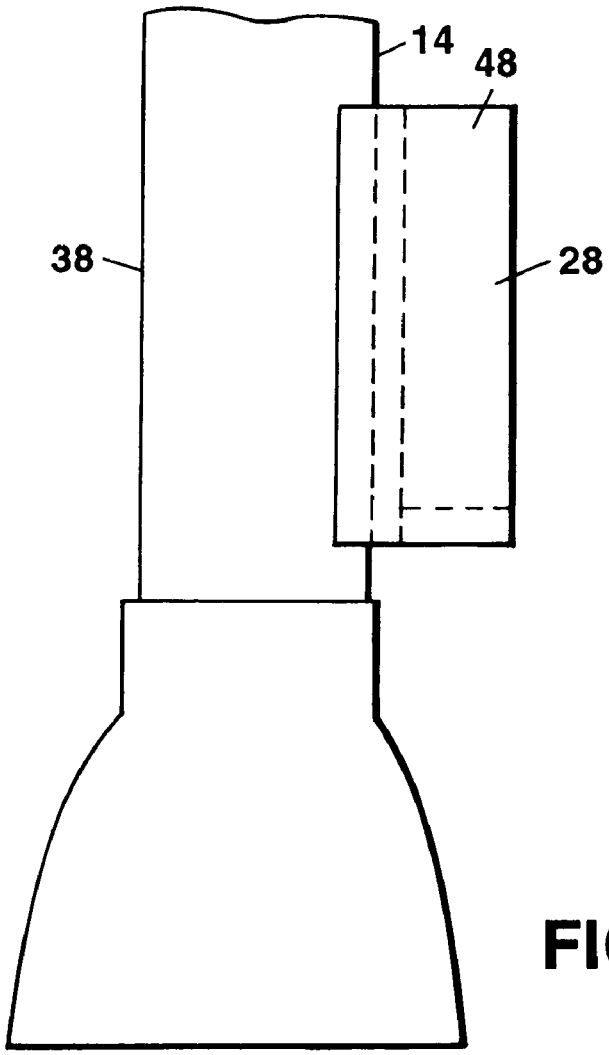
FIG. 2*a* is a partial view of the invention of FIGS. 1*a* and 1*b* illustrating an exemplary base member of one embodiment of the golf tee aid.
Figure 2B:
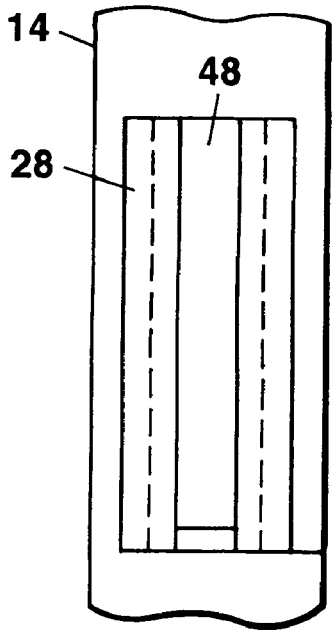
Figure 2D:
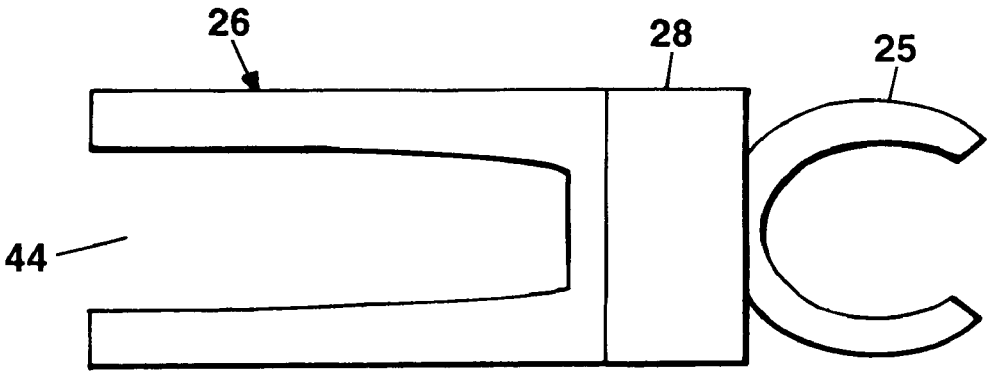
FIGS. 2*d–g* are top and side views, respectively, illustrating the means of removably attaching a golf tee aid to a golf ball aid.
Figure 2E:
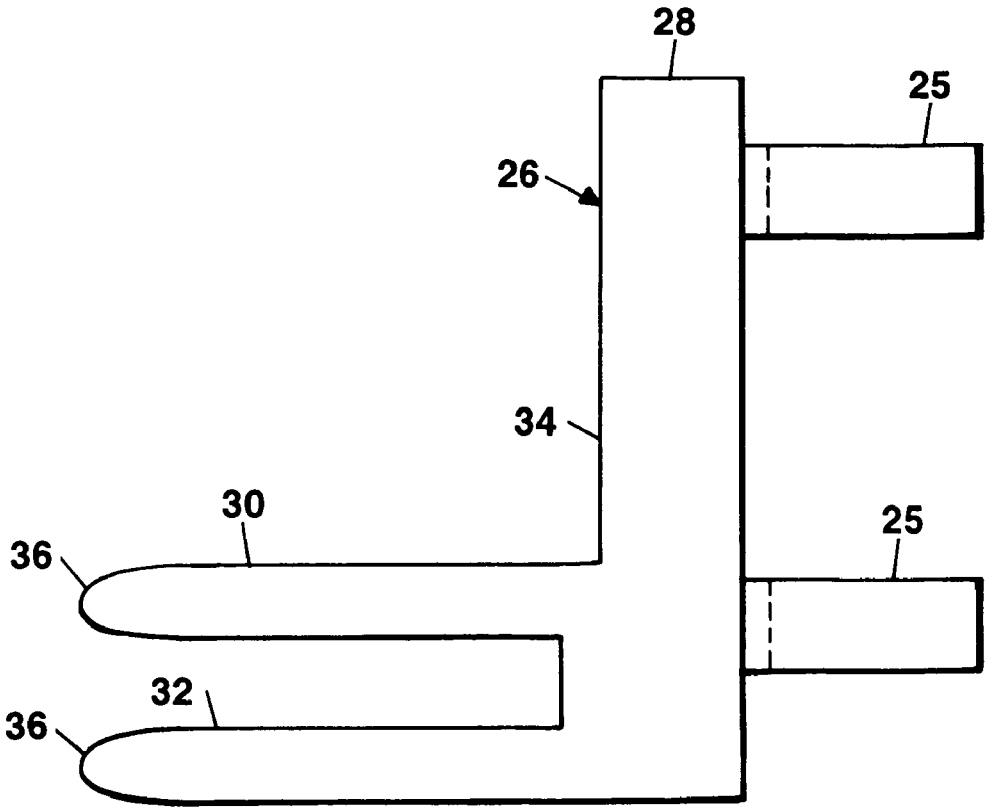

FIGS. 2*d* and 2*e* illustrate an exemplary attachment embodiment of the golf tee device 26 to the tube 14 by adapting clips 25 to base member 28. The clamping force of the clips 25 on to the tube 14 is sufficient to prevent the golf tee device 26 from sliding longitudinal up the tube 14 when a downward force is applied to the tube 14 to insert or position golf tees into the ground. However, modifications to the tube 14, for example, can be introduced to assure that the golf tee device 26 does not substantially move from a predetermined longitudinal position along the tube 14.

Figure 2F:
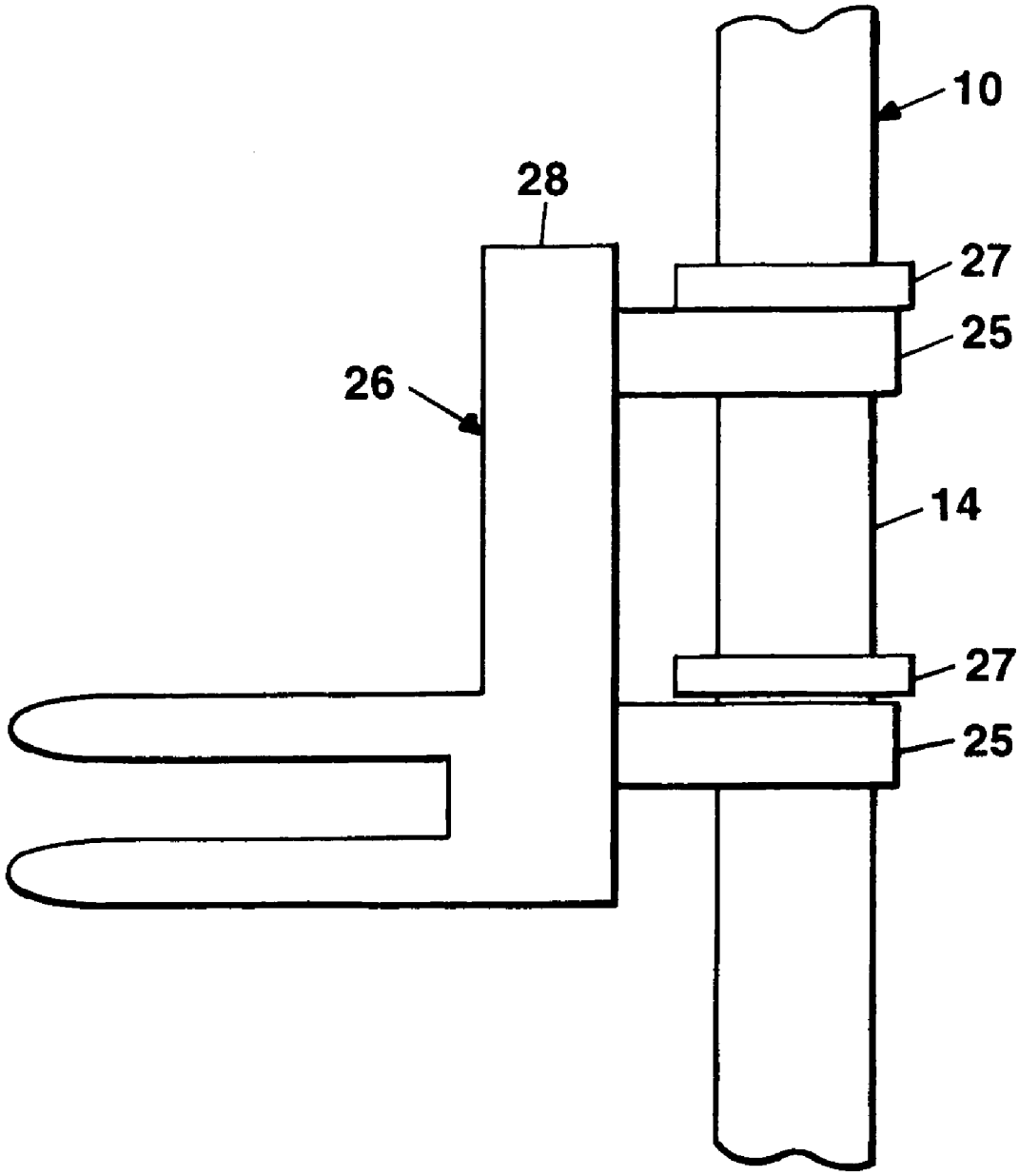

As illustrated in FIG. 2*f*, one such modification to the tube 14 includes retention sleeves or flanges 27 along the outer surface 42 of the tube 14. The clips 25 can be positioned below the retention sleeves or flanges 27. When a downward force is applied to the tube 14, the clips 25 contact the retention sleeves and maintain the predetermined longitudinal position along the tube 14.

Figure 2G:
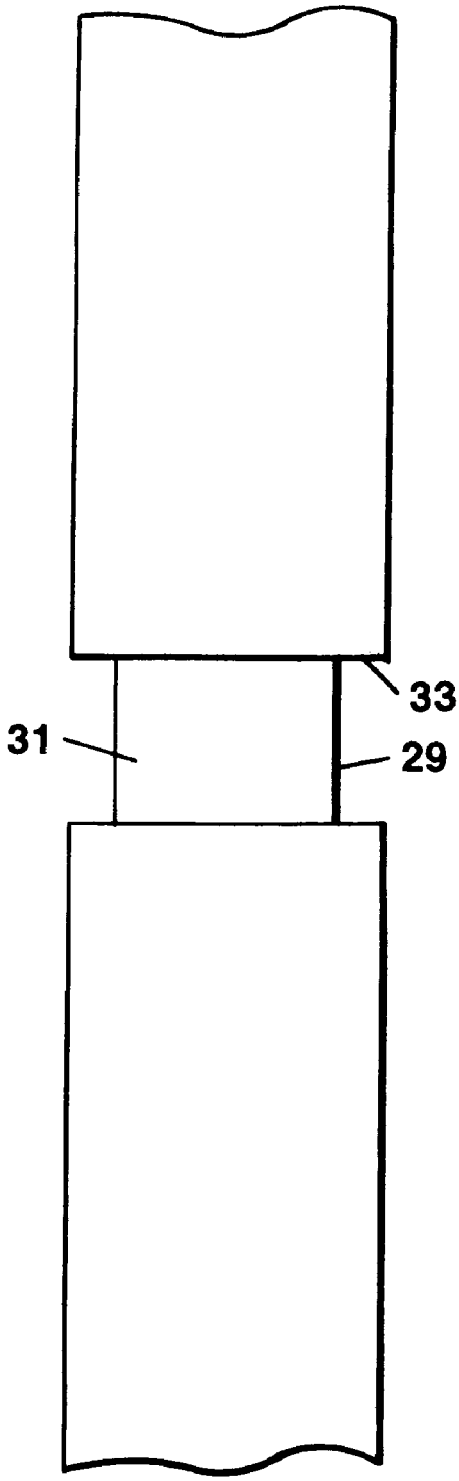

FIG. 2*g* illustrates yet another modification to the tube 14 including a substantially annular groove 29 along the outer surface 42 of the tube 14. The clips 25 are sized to fit securely about the outer surface 31 of the annular groove 29 such that when a downward force is applied to the tube 14, the clips 25 contact a surface 33 of the tube 14 and maintain the predetermined longitudinal position along the tube 14.

Now turning to FIGS. 2*a*–*e*, an alternative golf tee positioner 26 includes the base member 28 adjacent to a first end 38 of the rigid tube 14. The base member 28 includes a back surface 40 shaped and sized to conform to an outer surface 42 of the rigid tube 14. The upper forked projection 30 and the lower forked projection 32 can be attached to the base member 28 or, alternatively, the fork projections 30, 32 can be attached directly to the outer surface 42 of the rigid tube 14 (not shown).

Figure 3C:
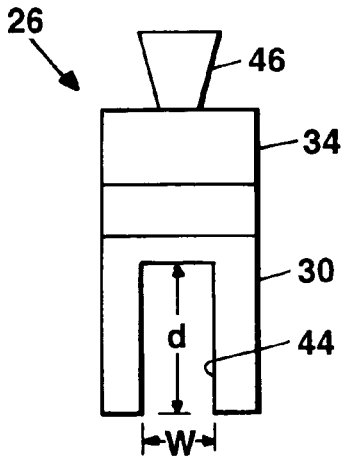
FIG. 3*a–c* are frontal, side, and top views illustrating an exemplary tee insertion and extraction device that is cooperative with the exemplary base member of golf tee aid of FIGS. 2*a–c*.
Figure 4:
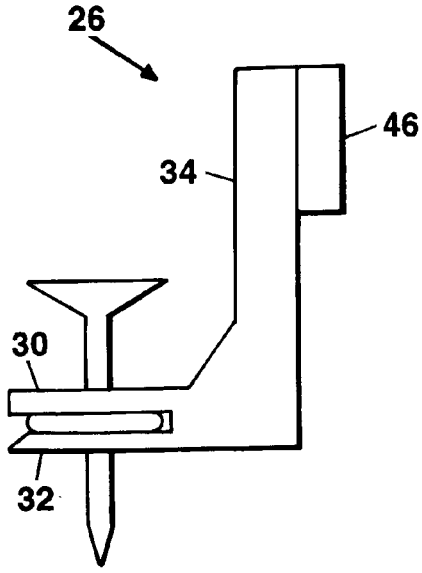
FIG. 4 a side view of a golf tee positioned within the exemplary tee insertion and extraction device of FIGS. 3*a–c*.

The forked projections 30, 32 are sufficiently spaced apart to receive a golf tee therebetween (FIG. 4). Each of the forked projections 30, 32 include a tee slot 44 having a width (w) and depth (d) sufficient to receive the tee head, a tee projection, or at least a shank of the golf tee (FIG. 3*c*). The upper forked projection 30 or lower forked projection 32 can act on the golf tee to transmit downward axial pressure to push the golf tee into the ground when a downward axial force is applied to the golf aid 8. The base member 28, the upper forked projection 30, and/or the lower forked projection 32 are made from material having characteristics to attract (such as magnetic) and to hold (such as adhesive) an object. For example, the golf tee can have metallic or magnetic fibers imbedded within or be made entirely of a metallic or magnetic materials. For example, the magnetized golf tee device 26 can pick up any object that contains magnetic characteristics.

Figure 3A:
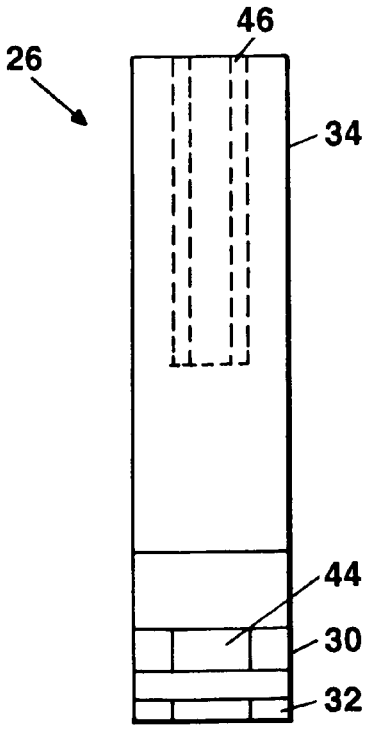
Figure 3B:
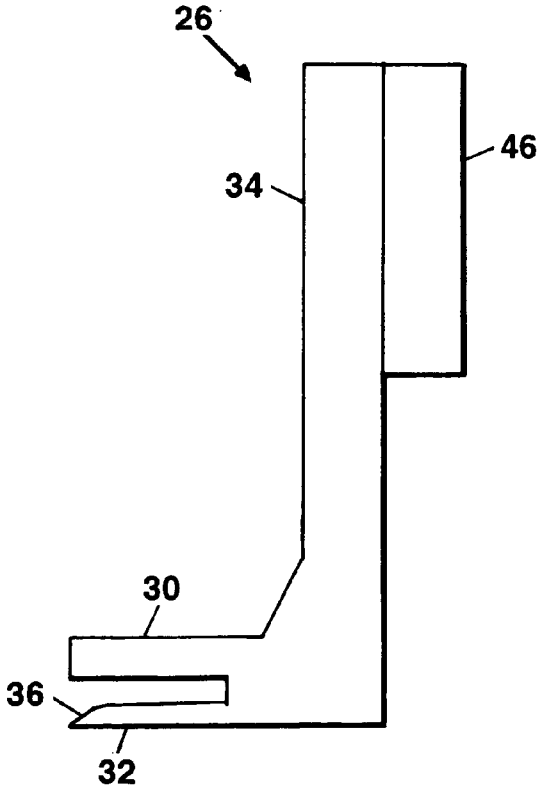

In the one embodiment of the golf tee device 26, the fork projections 30, 32 are connected to the base member 28 by an attachment block 34 that includes a attachment projection 46 (FIGS. 3*b*, 3*c*) complimentary in size and shape to cooperate with an attachment slot 48 of the base member 28 (FIGS. 2*a*–*c*). In one embodiment, the complimentary shape is a dovetail configuration. However any shape is adequate that retains the attachment projection 46 within the attachment slot 48.

Now returning to FIGS. 1*a* and 1*b*, the rigid tube 14 of a predetermined length further includes a second end 50. The end cap 16 is attached conventionally (as described below) to the second end 50 of the rigid tube 14. The end cup 16 may be connected to tube 14 in any conventional manner as, for example, by screw threaded engagement or by friction fit male and female joints between them.

The end cap 16 includes an access opening or hole 52 for the elongated member 20 to slide through when the elongated member 20 is acted upon by a force on the plunger end 58. In conjunction with the access opening or hole 86 of the resilient cup-like member 12, the access opening or hole 52 maintains a line of action of the elongated member 20 to facilitate smooth longitudinal translation of the elongated member 20 within the rigid tube 14. Though the elongated member line of action is described by openings attached in the ends of the rigid tube 14, the openings can be placed anywhere within the tube 14 that provides sufficient longitudinal alignment of the elongated member 20.

The elongated member 20 includes an ejector end 54, a middle section 56, and the plunger end 58. Also, the elongated member 20 has a predetermined length longer than the predetermined length of the rigid tube 14, such that at least one end of the elongated member 20 projects outside the rigid tube 14 at any given time. The plunger end 58 of the elongated member 20 can be made of material to attract and hold objects (such as a magnet or an adhesive/sticky substance).

The plunger knob 18 (FIG. 1*b*) can be optional and can be removably attached to the plunger end 58 of the elongated member 20. The plunger knob 18 may be connected to the plunger end 58 by any conventional manner as, for example, by screw threaded engagement (as shown) or by friction fit male and female joints between them. The plunger knob 18 can include an outer surface 60, a recess 62 in the outer surface 60, and an insert 64 disposed within the recess 62. The insert 64 has characteristics to attract (such as a magnet or an adhesive/sticky substance) and hold an object.

The elongated member 20 can further include a ball ejector 24 adjacent to the ejector end 54 of the elongated member 20 and disposed within the resilient cup-like element 12. The ball ejector 24 has a substantially concave surface, for example hemispherical, to conform to the size and shape of the golf ball.

An exemplary embodiment of the elongated member 20 includes a single diameter having collars 35 located at predetermined positions along the elongated member 20 to form a biasing member shoulder 72 and end cap shoulder 66 (described in detail below). The collars 35 can be permanently (for example, molded or machined) or removably attached to the elongated member 20 by conventional means. For example, one removable embodiment of the collar can be a washer member having a smaller hole diameter than the diameter of the elongated member. The collar 35 can be press fit on to the elongated member 20 to the desired, predetermined longitudinal distance thereon. The elongated member 20 can further include an annular groove (not shown) at the desired location to relieve stress on the elongated member 20 when the collar 35 is attached thereto. The collar 35 can fit loosely within the groove, but would not be able to move longitudinally along the elongated member 20.

An alternative embodiment of the elongated member 20 can further include an end cap shoulder 66 defined by a diameter 68 of the middle section 56 of the elongated member 20 and a diameter 70 of the plunger end 58 of the elongated member 20. The diameter 70 of the plunger end 58 of the elongated member 20 is smaller than the diameter 68 of the middle section 56. The access opening or hole 52 of the end cap 16 is larger than the diameter 70 of the plunger end 58 of the elongated member 20 and smaller than the diameter 68 of the middle section 56. The end cap shoulder 66 contacts the end cap 16 to stop the outward movement of the elongated member 20.

Alternatively stated, a diameter portion 70 of the plunger end 58 of the elongated member 20 is smaller than a diameter portion 68 of the middle section 56, and smaller than the access opening or hole 52 of the end cap 16. The diameter portion 68 of the middle section 56 is larger than the access opening or hole 52 of the end cap 16. Whereby, the larger diameter portion 68 of the middle section 56 contacts the end cap 16 to stop the outward movement of the elongated member 20 caused by the biasing member 22.

Further, the elongated member 20 further includes a biasing member shoulder 72 defined by the diameter 68 of the middle section 56 of the elongated member 20 and a diameter 74 of the ejector end 54 of the elongated member 20. The diameter 74 of the ejector end 54 of the elongated member 20 is smaller than the diameter 68 of the middle section 56. The biasing member shoulder 72 contacts the biasing member 22 to compress the biasing member 22 against a resilient cup-like element surface 23 during application of a force onto the plunger end 58 of the elongated member 20 and to push the elongated member 20 outward as the biasing member 22 decompresses when the force is removed.

Alternatively stated, the diameter portion 74 of the ejector end 54 of the elongated member 20 is smaller than the diameter portion 68 of the middle section 56 of the elongated member 20. Whereby, the diameter portion 68 of the middle section 56 of the elongated member 20 contacts the biasing member 22 to compress the biasing member 22 against a resilient cup-like element surface 23 during application of the force onto the plunger end 58 of the elongated member 20 and to push the elongated member 20 outward as the biasing member 22 decompresses when the force is removed.

The optional ball ejector 24 is capable of being removably attached to the ejector end 54 of the elongated member 20, as shown in FIG. 1*b*. The removable ball ejector 24 includes, for example, a threaded shaft 76 that screws into a threaded hole 78 of the middle section 56 of the elongated member 20. Alternatively, the ball ejector 24 can be a fixed or integrated element of the elongated member 20.

Alternatively, the plunger end 58 is capable of being removably attached to the middle section 56 of the elongated member 20 (as shown FIG. 1*b*) or the plunger knob 18 can be removably attached to the plunger end 58 of the elongated member 20 (not shown) in a similar manner. The plunger end 58 includes, for example, a threaded shaft 80 that screws into a threaded hole 82 of the middle section 56 of the elongated member 20. Alternatively, the plunger end 58 can be a fixed or integrated element of the elongated member 20.

As discussed above, the elongated member 20 is slidably disposed within the rigid tube 14 along a line of action defined by the access opening or hole 86 of the resilient cup-like element 12 and the access opening or hole 52 of the end cap 16. The elongated member 20 is axially supported and spaced away from the rigid tube 14, so that it does not make direct contact with the inner surface of the rigid tube 14 and to promote sliding engagement therebetween. This arrangement of alignment openings or holes eliminates the need of bearings.

The resilient cup-like element 12 attached to the first end 38 of the rigid tube 14 is sized and adapted to pick up a golf ball. The golf ball may be retained in the resilient cup-like element 12 by a snap-fit, suction, frictional engagement, or any other suitable means as is known in the art. The resilient cup-like element 12 includes an access opening or hole 86 for the elongated member 20 to slide through when the elongated member 20 is acted upon by a force on the plunger end 18. The resilient cup-like element 12 is typically made from a rubber or plastic or other elastic polymer.

Further, the resilient cup-like element 12 formed of resilient material comprises a shallow socket 13 having a shallow vertical wall 15 and an annular opening 17 generally sized so that its outside circumference conforms to the diameter of a golf ball. The shallow socket 13 can be a substantially hemispherical cup having an internal dimension to grip a golf ball so that it may be supported in the downwardly open cup without falling out under its own weight. Suitably, the resilient cup-like element 12 may be made of material so that it has some flexibility to release the golf ball when required to do so. While the shape of the cup is conveniently hemispherical, some departure from this shape is possible. For example, the shape may, while conforming to the shape of a chordal section of the golf ball, need not be a full hemisphere. A minor section sufficient to grip the ball is sufficient. Moreover, it is not necessary that the internal shape be a hemisphere at all, providing that a ball gripping band 19 is present.

The resilient cup-like element 12 is connected to tube 14 through its base 21 to be coaxial therewith. Base 21 is provided with the access opening or hole 86 to allow passage of one end of the elongated member 20 on sliding in one direction. The resilient cup-like element 12 may be connected to tube 14 in any conventional manner as, for example, by screw threaded engagement or by friction fit male and female joints between them (FIG. 1).

The plunger knob 18 includes a predetermined diameter portion 84 larger than the access opening or hole 52 of the end cap 16, whereby an inward motion of the elongated member 20 stops when the plunger knob 18 contacts the end cap 16.

The biasing member 22 is disposed within the rigid tube 14 and in contact with the elongated member 20 or collars 35 for biasing the elongated member 14 in response to the force applied to the plunger knob 18 to eject the golf ball from the resilient cup-like element 12 when the ejector end 54 of the elongated member 20 applies sufficient force onto the golf ball. The biasing member 22 provides sufficient bias caused by the storage of potential energy to return the elongated member 20 to substantially its initial position when the force is removed. The exemplary biasing member 22 is a helix spring, but any device that produces a reactive force to counter an input force applied to the elongated member 20 is acceptable. The biasing force may be maintained upon the elongated member 20 to hold the elongated member 20 in a retracted position such that the elongated member 20 does not act upon the golf ball until actuated. The biasing member 22 may be placed between the resilient cup-like element 12 and biasing member shoulder 72 or diameter portion 68 of the middle section 56 of the elongated member 20 or collars 35 (discussed above). The biasing member shoulder 72 or diameter portion 68 or collars 35 engages the biasing member 22 to provide a bias to return the elongated member 20 back into its original position after the ball is ejected.

The rigid tube 14 may be of any suitable diameter and length and is preferably about ⅞ inches in the outer diameter and about 24 inches long. The rigid tube 14 material can be any suitable material such as plastic, metal, composite, or wood.

The elongated member 20 may be of any suitable length and diameters, and is preferably about 27 inches long, and the diameters of the ejector end, middle section, and plunger end are any diameter that are sufficient to form the ejector and plunger shoulders, and strong enough to withstand the force applied to the elongated member 20 to overcome the resistance of the golf ball within the resilient cup-like element. The elongated member 20 material can be any suitable material such as plastic, metal, composite, or wood.

In operation, to retrieve a golf ball from the ground without the necessity of the golfer bending down to pick it up, the device 8 may be utilized as follows:

The device 8 is held by the user in a generally vertical position with the resilient cup-like element 12 open downwardly. The device 8 should be located so that the resilient cup-like element 12 opens directly above golf ball to be retrieved. The resilient cup-like element 12 is lowered onto the golf ball and, perhaps, a small amount of pressure may be exerted to locate the golf ball in the resilient cup-like element 12. The device may then be reversed or lifted so that the resilient cup-like element 12 is conveniently accessible by the user and the ball may be picked out of it.

The reverse order of the above-describe operation is followed to place the golf ball on the tee. The golfer places the golf ball in the resilient cup-like element 12 and reverse the device 8 in a generally vertical position so that the golf ball directly above golf tee. The golf ball is lowered onto the golf tee. The plunger end 58 can be depressed minimally to move the elongated member 20 axially so the ball ejector 24 or ejector end 54 contacts the golf ball to dislodge the golf ball gently and accurately when placing the ball on a tee. Contact of the plunger end 58 with the end cap 16 provides a stop for movement of the elongated member 20 in this direction. It may be advantageous that the ball ejector 24 or ejector end 54 does not project very far into the resilient cup-like element 12 so that ejection of the ball is not too vigorous.

In operation, to set a tee in the ground, the user may locate the golf tee device 26 so that it is easily accessible. The user may then set a tee head or tee special projection between the upper and lower fork projections 30, 32 so that the tee is slidably retained by the fork projections 30, 32 (FIG. 4). Once the tee is positioned within the projections 30, 32, the golf aid 8 may be located with the tee ready for insertion into the ground at the desired location. Downward pressure on the golf aid 8 will cause an abutment of the upper fork projection 30 with the tee head or tee projection to bear downwardly on the tee and press the tee into the ground. It may be possible, at this point, to remove the golf aid 8 from the embedded tee by sliding the golf aid 8 in a direction perpendicular to the tee head or tee projection.

When it is desired to retrieve a tee imbedded in the ground, end portions 36 of the lower projection 32 can be tapered and capable of being wedged below the tee head or tee projection, and the tee head or tee projection slides between the upper 30 and lower fork projections 32. The golf aid 8 is pried or lifted to extract the tee from the ground.

In the case where the tee is extracted from the ground but not retained between the upper 30 and lower fork projections 32 (e.g., loose on the ground), the attractive characteristics between one of the base 28, the upper fork projection 30, or lower fork projection 32 or plunger 18 and the tee or tee projection will attract and hold to tee or tee projection to the golf tee aid 26.

Although the invention has been described with respect to various embodiments, it should be realized this invention is also capable of a wide variety of further and other embodiments within the spirit and scope of the appended claims and the doctrine of equivalents.

What is claimed is:

1. A golf aid for retrieving and positioning a golfing article comprising:

a tube having a predetermined length, a first end, a second end, and an outer surface;

an elongated member having an ejector end, a middle section, and a plunger end, said elongated member having a predetermined length longer than said predetermined length of said tube;

a resilient cup-like element attached to said first end of said tube, said resilient cup-like element being capable of frictionally retaining a golf ball therein, said resilient cup-like element having an access opening therein;

said elongated member being slidably disposed within said tube along a line of action substantially defined by said access opening of said resilient cup-like element and an access opening of said second end of said tube; and a biasing member disposed within said tube and in contact with said elongated member for biasing said elongated member in response to a force applied to said plunger end of said elongated member to eject the golf ball from said resilient cup-like element when said ejector end of said elongated member applies sufficient force onto the golf ball, said biasing member providing sufficient biasing to return said elongated member to substantially its initial position when the force is removed; and a golfing tee placing member located adjacent said first end of said tube, said golf tee placing member having:

a base having a back surface being shaped and sized to conform to said outer surface of said tube; and an upper forked projection and a lower forked projection attached to said base, said forked projections being sufficiently spaced apart to receive a golf tee therebetween, each of said forked projections comprises a slot having a width and depth sufficient to receive at least a shank of the golf tee, wherein said upper forked projection acts on the golf tee to transmit downward axial pressure to push the golf tee into the ground when a downward axial force is applied to said golf aid.

2. The golf aid according to claim 1, further comprising an end cap having an access opening therein being capable of attachment to said second end of said tube.

3. The golf aid according to claim 2, wherein a diameter portion of said plunger end of said elongated member is smaller than a diameter portion of said middle section of said elongated member, wherein said access opening of said end cap is larger than said diameter portion of said plunger end of said elongated member and smaller than said diameter portion of said middle section of said elongated member, whereby said larger diameter portion of said middle section of said elongated member contacts said end cap to stop the outward movement of said elongated member.

4. The golf aid according to claim 1, wherein said plunger end is made from material having characteristics to attract and hold an object.

5. The golf aid according to claim 1, further comprising a magnetic material attached to an outer surface of said plunger end of said elongated member.

6. The golf aid according to claim 1, further comprising a plunger knob adjacent said plunger end of said elongated member, said plunger knob including an outer surface, a recess in said outer surface, and an insert disposed within said recess, said insert having characteristics to attract and magnetically hold an object.

7. The golf aid according to claim 6, wherein said plunger knob is capable of being removably attached to said plunger end of said elongated member.

8. The golf aid according to claim 6, further comprising an end cap having an access opening therein being capable of attachment to said second end of said tube; wherein said plunger knob comprises a predetermined portion larger than said access opening of said end cap, whereby the inward motion of said elongated member stops when said plunger knob contacts said end cap.

9. The golf aid according to claim 1, wherein at least one of said base, said upper forked projection, and said lower forked projection are made from material having characteristics to attract and hold an object.

10. The golf aid according to claim 1, wherein said elongated member further comprises a ball ejector adjacent to said ejector end of said elongated member and disposed within said resilient cup-like element.

11. The golf aid according to claim 10, wherein said ball ejector is capable of being removably attached to said ejector end of said elongated member.

12. The golf aid according to claim 1, wherein a diameter portion of said ejector end of said elongated member is smaller than a diameter portion of said middle section of said elongated member, whereby said diameter portion of said middle section of said elongated member contacts said biasing member to compress said biasing member during application of the force onto said plunger end of said elongated member and to bias said elongated member outward as said biasing member decompresses when the force is removed.

13. A golf aid for the retrieving and positioning a golf tee comprising:

a base capable of being attached to an elongated object, said base having a back surface being shaped and sized to conform to an outer surface of said elongated object;

an upper forked projection and a lower forked projection attached to said base, said forked projections being sufficiently spaced apart to receive a golf tee therebetween, each of said forked projections comprises a slot having a width and depth sufficient to receive at least a shank of the golf tee, wherein said upper forked projection acts on the golf tee to transmit downward axial pressure to push the golf tee into the ground when a downward axial force is applied to said golf aid; and wherein at least one of said base, said upper forked projection, and said lower forked projection are made from material having characteristics to attract and hold an object.

14. The golf aid according to claim 13, wherein at least one of said upper forked projection and said lower forked projection includes a tapered end sufficiently configured to be wedged below a head or a projection of the tee imbedded in the ground, such that the tee can be pried or lifted to extract the tee from the ground.

* * * * *